United States Patent [19]

Meyers

[11] 4,100,645

[45] Jul. 18, 1978

[54] BUSHING

[75] Inventor: Earl Meyers, Kitchener, Canada

[73] Assignee: Clemmer Industries (1964) Limited, Waterloo, Canada

[21] Appl. No.: 815,896

[22] Filed: Jul. 15, 1977

[30] Foreign Application Priority Data

Apr. 18, 1977 [CA] Canada ..... 276353

[51] Int. Cl.[2] ..... B65D 55/00

[52] U.S. Cl. ..... 16/2; 285/177; 308/237 R

[58] Field of Search ..... 16/2; 285/231, 177, 285/343, 357, 365, 367; 151/41.73; 403/223, 225; 308/237 R, 237 A

[56] References Cited

U.S. PATENT DOCUMENTS

| | | | |
|---|---|---|---|
| 1,822,887 | 9/1931 | Hagstedt | 16/2 X |
| 2,437,843 | 3/1948 | Van Ness | 285/231 |
| 3,103,962 | 9/1963 | Neuschotz | 151/41.73 |
| 3,462,539 | 8/1969 | Winston | 285/357 X |

FOREIGN PATENT DOCUMENTS

| | | | |
|---|---|---|---|
| 693,903 | 9/1964 | Canada | 285/177 |

*Primary Examiner*—Dorsey Newton

*Attorney, Agent, or Firm*—Lawrence I. Field

[57] ABSTRACT

A bushing for use with an underground storage tank, consisting of a wall having inner and outer screw threads, the outer thread being a standard taper of 1° 47′ and the inner thread being a non-standard taper of between 1° - 48′ and 16° - 47′.

9 Claims, 1 Drawing Figure

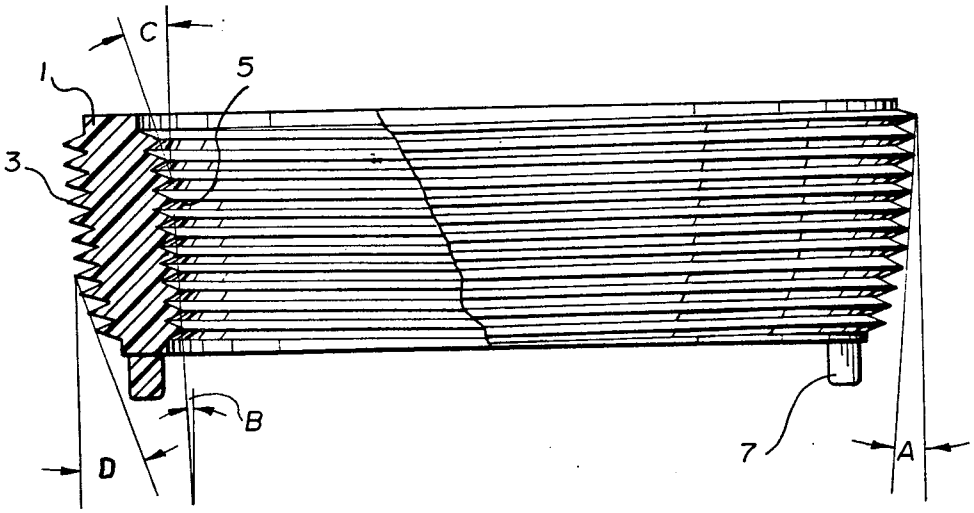
A
7
B
5
C
D
1
3

BUSHING

This invention relates to a bushing, the main use being for installation between steel underground storage tanks for combustible liquids and piping to and from such tanks.

The Underwriters' Laboratories of Canada have strict standards regarding the storage of combustible liquid in underground tanks and their standard requirements for bushings between pipe connections and a steel tank are that the bushing shall be a low profile nylon bushing of monomer cast nylon stock and capable of being installed so it will not have to be removed or further tightened in the field. There are various other physical and chemical properties required of the bushing material, however these properties are already met by known bushings.

In order to meet the Underwriters' Laboratories standards, nylon bushings have been utilized which have standard identical inner and outer threaded tapers. However, nylon changes shape when aging due to cold flow and the standard nylon bushing therefore has a tendency to become loose as the standard taper threads of the bushing retract away from the standard thread tapers of the steel tank and the pipe.

The bushing of this invention is made with a standard outside taper and non-standard inside taper. By utilizing such a construction, instead of achieving a large area of contact as is achieved with standard tapers, the mating of a standard taper pipe with a non-standard inner bushing taper, creates a point contact which is under a relatively large pressure such that when shrinkage of the bushing occurs, the region of the point contact merely becomes larger. The pressure at the point contact is also transmitted to the outer thread through the bushing so ensuring a good contact at the inner and outer threads of the bushing. For easy entry of the bushing, an increased angle is formed at the smallest diameter of the outer taper and the largest diameter of the inner taper, this increased entry angle also ensuring that the bushing can be utilized even if it has experienced cold flow during storage.

The invention will now be described with reference to the accompanying drawing which shows a side elevational view of the bushing, the upper part being sectioned through the center of the bushing.

Referring to the drawing; the bushing consists of a wall member 1 having an outer thread 3 and an inner thread 5. The outer thread 3 is tapered to the axis of the bushing at an angle A which is of a standard taper of 1° 47′. The inner threads 5 are tapered to the axis of the bushing at an angle B which is from 1° to 15° larger than a standard taper, i.e. (1° – 48′ to 16° – 47′) and preferably 2° 47′. The outer thread 3 is also tapered at a greater angle D at the smallest diameter for approximately ⅓ of the length of the bushing to provide easy entry of the bushing into a tank. The increased angle which has been found to be acceptable is between 1° – 48′ and 25° – 47′ and preferably 4° 30′. The inner thread 5 also has a larger angle C at its largest diameter to permit easy entry of a pipe even if the diameter of the bushing has become smaller because of cold flow. An acceptable angle has been found to be between 1° – 48′ and 25° – 47′ and preferably 5° 47′.

Projections such as 7 can be used to more easily locate the bushing when installing it in a tank.

As further assistance in helping to maintain a seal which will not leak, it is preferable to use a type of nylon which expands as it absorbs moisture such that the seal will become tighter after it is buried in the ground. A suitable type of nylon has been found to be nylon 66 which is sold under many names, one being the trade mark ZYTEL 101.

The embodiments of the invention in which an exclusive property or privilege is claimed are defined as follows:

1. A bushing for use with an underground storage tank, consisting of a wall having inner and outer screw threads, the outer thread being a standard taper of 1°47′ over most of its length, and the inner thread being a non-standard larger taper than the outer thread over most of its length, the outer thread having a taper for the last few threads at its smallest outer diameter of the bushing of a larger angle than the major part of the outer thread.

2. The bushing of claim 1, wherein the inner thread has an easy entry end at its largest diameter at a larger angle than the major part of the inner thread.

3. The bushing of claim 1, wherein the material is nylon of a type which expands as it absorbs moisture.

4. The bushing of claim 1, wherein the inner thread is of an angle between 1° 48′ and 16° 47′.

5. The bushing of claim 4, wherein the inner thread is of an angle of 2° 47′.

6. The bushing of claim 1, wherein the easy entry angle of the outer thread is of an angle between 1° 48′ and 25° 47′.

7. The bushing of claim 6, wherein the easy entry angle of the outer thread is of an angle of 4° 30′.

8. The bushing of claim 2, wherein the easy entry end of the inner thread is of an angle between 1° 48′ and 25° 47′.

9. The bushing of claim 8, wherein the easy entry end of the inner thread is of an angle of 5° 47′.

* * * * *